US006052111A

United States Patent [19]

Shimura

[11] Patent Number: 6,052,111

[45] Date of Patent: Apr. 18, 2000

[54] METHOD OF REPRODUCING IMAGE

[75] Inventor: Kazuo Shimura, Kanagawa-ken, Japan

[73] Assignee: Fuji Photo Film Co., Ltd., Kanagawa-ken, Japan

[21] Appl. No.: 08/723,565

[22] Filed: Sep. 30, 1996

[30] Foreign Application Priority Data

Sep. 29, 1995 [JP] Japan ..... 7-252509

[51] Int. Cl.[7] ..... G09G 5/10

[52] U.S. Cl. ..... 345/147; 378/98.7

[58] Field of Search ..... 345/147, 77, 20; 378/87, 91, 98.7

[56] References Cited

U.S. PATENT DOCUMENTS

| | | | |
|---|---|---|---|
| 4,851,678 | 7/1989 | Adachi et al. | 250/327.2 |
| 4,931,644 | 6/1990 | Adachi et al. | 250/327.2 |
| 5,513,239 | 4/1996 | Mulder | 378/98.7 |

FOREIGN PATENT DOCUMENTS

| | | | |
|---|---|---|---|
| 63-100437 | 5/1988 | Japan | G03B 42/02 |

*Primary Examiner*—Matthew Luu

*Attorney, Agent, or Firm*—Sughrue, Mion, Zinn, Macpeak & Seas, PLLC

[57] ABSTRACT

An image is reproduced on a light emission display system such as a CRT by use of an image signal obtained from the image. The image to be reproduced is an image which is taken by use of an irradiation field stop and the image signal is obtained from the image in such a manner that image signal components obtained from an area outside the irradiation field becomes lower in signal level than those obtained from the area inside the irradiation field. The image is reproduced as a visible image on the light emission display system according to gradation properties where the brightness level of a picture element becomes higher as the level of the image signal component for the picture element becomes lower. A picture element the signal level of the image signal component for which is not higher than a predetermined threshold value is displayed at a brightness within a predetermined lowest brightness level range.

8 Claims, 7 Drawing Sheets

METHOD OF REPRODUCING IMAGE

BACKGROUND OF THE INVENTION

1. Field of the Invention

This invention relates to a method of reproducing an image which is taken with an irradiation field limited as a visible image on a light emission display means such as a CRT.

2. Description of the Related Art

There has been known a medical image display system in which, for instance, a stimulable phosphor sheet is exposed to a radiation passing through an object to have a radiation image of the object stored thereon and then exposed to stimulating rays which cause the stimulable phosphor sheet to emit light in proportion to the stored radiation energy, the light emitted from the stimulable phosphor sheet is photoelectrically detected and converted to an electric image signal, and the radiation image of the object is reproduced as a visible image on a light emission display means such as a CRT on the basis of the electric image signal.

In such a system, the image signal is subjected to image processing so that the radiation image is reproduced according to gradation properties where the brightness level of a picture element becomes higher as the level of the image signal component for the picture element becomes lower and the radiation image is reproduced as a visible image by use of the processed image signal.

When recording a radiation image, it is sometimes desired that portions of the object not related to diagnosis or the like be prevented from being exposed to the radiation. Further when the object portions not related to diagnosis or the like are exposed to the radiation, the radiation is scattered by such object portions to the portion related to diagnosis or the like and the image quality is deteriorated. Accordingly a radiation image is sometimes recorded using an irradiation field stop so that only a necessary portion of the object is exposed to the radiation. Conventionally also a radiation image taken using such an irradiation field stop is reproduced according to gradation properties where the brightness level of a picture element becomes higher as the level of the image signal component for the picture element becomes lower as a radiation image taken without using an irradiation field stop.

In the case of a radiation image taken using an irradiation field stop, the image signal components obtained from the area of the stimulable phosphor sheet outside the irradiation field are very low in level since the area is not exposed to the radiation and the amount of light emitted from the area upon stimulation is very small. As a result, the area outside the irradiation field is reproduced at a high brightness on the CRT or the like. To the contrast, the image signal components obtained from the area of the stimulable phosphor sheet inside the irradiation field are high in level since the area inside the irradiation field is exposed to the radiation and the amount of light emitted from the area upon stimulation is in proportional to the radiation energy. As a result, the area inside the irradiation field is reproduced on the CRT or the like at a brightness lower than the area outside the irradiation field.

The image reproduction described above is for reproducing a radiation image, which is stored on a stimulable phosphor sheet and in which the image signal level of the area outside the irradiation field is lower than that of the area inside the irradiation field, on a light emission display means such as a CRT according to gradation properties where the brightness level of a picture element becomes higher as the level of the image signal component for the picture element becomes lower. There also has been known an image reproduction where an X-ray image of an object is recorded on an X-ray film, the X-ray film is developed, an image signal is obtained by scanning the developed X-ray film and reading out transmitted light or reflected light (digitization of an X-ray film), and the X-ray image is reproduced as a visible image on a light emission display means such as a CRT on the basis of the image signal.

In this case, the image signal level of the area outside the irradiation field is higher than that of the area inside the irradiation field and the X-ray image is reproduced on the light emission display means according to gradation properties where the brightness level of a picture element becomes higher as the level of the image signal component for the picture element becomes higher. Also in this case, the area inside the irradiation field is reproduced on the CRT or the like at a brightness lower than the area outside the irradiation field.

However reproducing an image on a light emission display system such as a CRT involves a difficulty that when an image area at a high brightness level exists adjacent to an image area at a low brightness level, the contrast of the image in the low brightness level area is deteriorated due to scattered light from the high brightness level area.

For example, in the case of a CRT, phosphors emit light and glass plate exists on the front face of the CRT. There are scattered light from the light emitted from the phosphors and scattered light scattered at the glass plate. When there is a high brightness level area adjacent to a low brightness level area, the brightness level in the low brightness level area is increased by scattered light from the phosphors in the high brightness level area and scattered light at the glass plate, which results in deterioration in contrast.

Thus there has been a problem in the conventional image reproducing method that when the image to be reproduced is an image taken using an irradiation field stop, the contrast of the image inside the irradiation field (low brightness lever area) is deteriorated by scattered light from the image outside the irradiation field (high brightness level area), which is undesirable in viewing for diagnostic purposes.

SUMMARY OF THE INVENTION

In view of the foregoing observations and description, the primary object of the present invention is to provide a method of reproducing an image, taken with an irradiation field stop, on a light emission display system such as a CRT which can prevent deterioration in contrast of the area inside the irradiation field due to scattered light from the area outside the irradiation field.

In accordance with a first aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes lower in signal level than those obtained from the area inside the irradiation field, the image is reproduced as a visible image on the light emission display system according to gradation properties where the brightness level of a picture element becomes higher as the level of the image signal component for the picture element becomes lower, wherein the improvement comprises that a picture element the signal level of the image signal component for which is not higher than a predetermined threshold value is displayed at a brightness within a predetermined lowest brightness level range.

In this method, when the threshold value is set to be lower than the lowest value of the image signal levels for the area inside the irradiation field and higher than the highest value of the image signal levels for the area outside the irradiation field or a value close to the highest value, the area outside the irradiation field can be reproduced substantially at a black level, whereby deterioration in contrast of the area inside the irradiation field due to scattered light from the area outside the irradiation field can be prevented.

In accordance with a second aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes higher in signal level than those obtained from the area inside the irradiation field, the image is reproduced as a visible image on the light emission display system according to gradation properties where the brightness level of a picture element becomes higher as the level of the image signal component for the picture element becomes higher, wherein the improvement comprises that a picture element the signal level of the image signal component for which is not lower than a predetermined threshold value is displayed at a brightness within a predetermined lowest brightness level range.

In this method, when the threshold value is set to be higher than the highest value of the image signal levels for the area inside the irradiation field and lower than the lowest value of the image signal levels for the area outside the irradiation field or a value close to the lowest value, the area outside the irradiation field can be reproduced substantially at a black level, whereby deterioration in contrast of the area inside the irradiation field due to scattered light from the area outside the irradiation field can be prevented.

In accordance with a third aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes lower in signal level than those obtained from the area inside the irradiation field, the image is reproduced as a visible image on the light emission display system according to gradation properties where the brightness level of a picture element becomes higher as the level of the image signal component for the picture element becomes lower, wherein the improvement comprises that a picture element the signal level of the image signal component for which is not higher than a predetermined threshold value is displayed at an inverted brightness level.

In this method, when the threshold value is set to be lower than the lowest value of the image signal levels for the area inside the irradiation field and higher than the highest value of the image signal levels for the area outside the irradiation field or a value close to the highest value, the area outside the irradiation field can be reproduced substantially at a black level, whereby deterioration in contrast of the area inside the irradiation field due to scattered light from the area outside the irradiation field can be prevented.

In accordance with a fourth aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes higher in signal level than those obtained from the area inside the irradiation field, the image is reproduced as a visible image on the light emission display system according to gradation properties where the brightness level of a picture element becomes higher as the level of the image signal component for the picture element becomes higher, wherein the improvement comprises that a picture element the signal level of the image signal component for which is not lower than a predetermined threshold value is displayed at an inverted brightness level.

In this method, when the threshold value is set to be higher than the highest value of the image signal levels for the area inside the irradiation field and lower than the lowest value of the image signal levels for the area outside the irradiation field or a value close to the lowest value, the area outside the irradiation field can be reproduced substantially at a black level, whereby deterioration in contrast of the area inside the irradiation field due to scattered light from the area outside the irradiation field can be prevented.

In accordance with a fifth aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes lower in signal level than those obtained from the area inside the irradiation field, the image is reproduced as a visible image on the light emission display system according to gradation properties where the brightness level of a picture element becomes higher as the level of the image signal component for the picture element becomes lower, wherein the improvement comprises that when the area outside the irradiation field is known, the image signal is processed with a mask corresponding to the area outside the irradiation field so that each picture element in the area outside the irradiation field is displayed at a brightness within a predetermined lowest brightness level range and the image is reproduced by use of the processed image signal.

In accordance with a sixth aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes higher in signal level than those obtained from the area inside the irradiation field, the image is reproduced as a visible image on the light emission display system according to gradation properties where the brightness level of a picture element becomes higher as the level of the image signal component for the picture element becomes higher, wherein the improvement comprises that when the area outside the irradiation field is known, the image signal is processed with a mask corresponding to the area outside the irradiation field so that each picture element in the area outside the irradiation field is displayed at a brightness within a predetermined lowest brightness level range and the image is reproduced by use of the processed image signal.

Also in the methods in accordance with the fifth and sixth aspects of the present invention, the area outside the irradiation field can be reproduced substantially at a black level, whereby deterioration in contrast of the area inside the irradiation field due to scattered light from the area outside the irradiation field can be prevented.

In accordance with a seventh aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes lower in signal level than those obtained from the area inside the irradiation field, the image is reproduced as a visible image on the light emission display system according to gradation properties where the brightness level of a picture element becomes higher as the level of the image signal component for the picture element becomes lower, wherein the improvement comprises that the area outside the irradiation field is recognized on the basis of the image signal, and each picture element in the recognized area outside the irradiation field is displayed at a brightness within a predetermined lowest brightness level range.

In accordance with an eighth aspect of the present invention, there is provided a method of reproducing an image on a light emission display system such as a CRT by use of an image signal obtained from the image in which, when the image to be reproduced is an image which is taken by use of an irradiation field stop and the image signal is obtained from the image in such a manner that image signal components obtained from an area outside the irradiation field becomes higher in signal level than those obtained from the area inside the irradiation field, the image is reproduced as a visible image on the light emission display system according to gradation properties where the brightness level of a picture element becomes higher as the level of the image signal component for the picture element becomes higher, wherein the improvement comprises that the area outside the irradiation field is recognized on the basis of the image signal, and each picture element in the recognized area outside the irradiation field is displayed at a brightness within a predetermined lowest brightness level range.

Also in the methods in accordance with the seventh and eighth aspects of the present invention, the area outside the irradiation field can be reproduced substantially at a black level, whereby deterioration in contrast of the area inside the irradiation field due to scattered light from the area outside the irradiation field can be prevented.

DESCRIPTION OF THE PREFERRED EMBODIMENTS

In each of the embodiments described hereinbelow, the image signal is obtained in the following manner. That is, an object is exposed to radiation through an irradiation field stop and a stimulable phosphor sheet is exposed to the radiation passing through the object and its surrounding to have a radiation image of the object stored thereon. Then the stimulable phosphor sheet is exposed to stimulating rays which cause the stimulable phosphor sheet to emit light in proportion to the stored radiation energy, and the light emitted from the stimulable phosphor sheet is photoelectrically detected and converted to an electric image signal.

Figure 1:
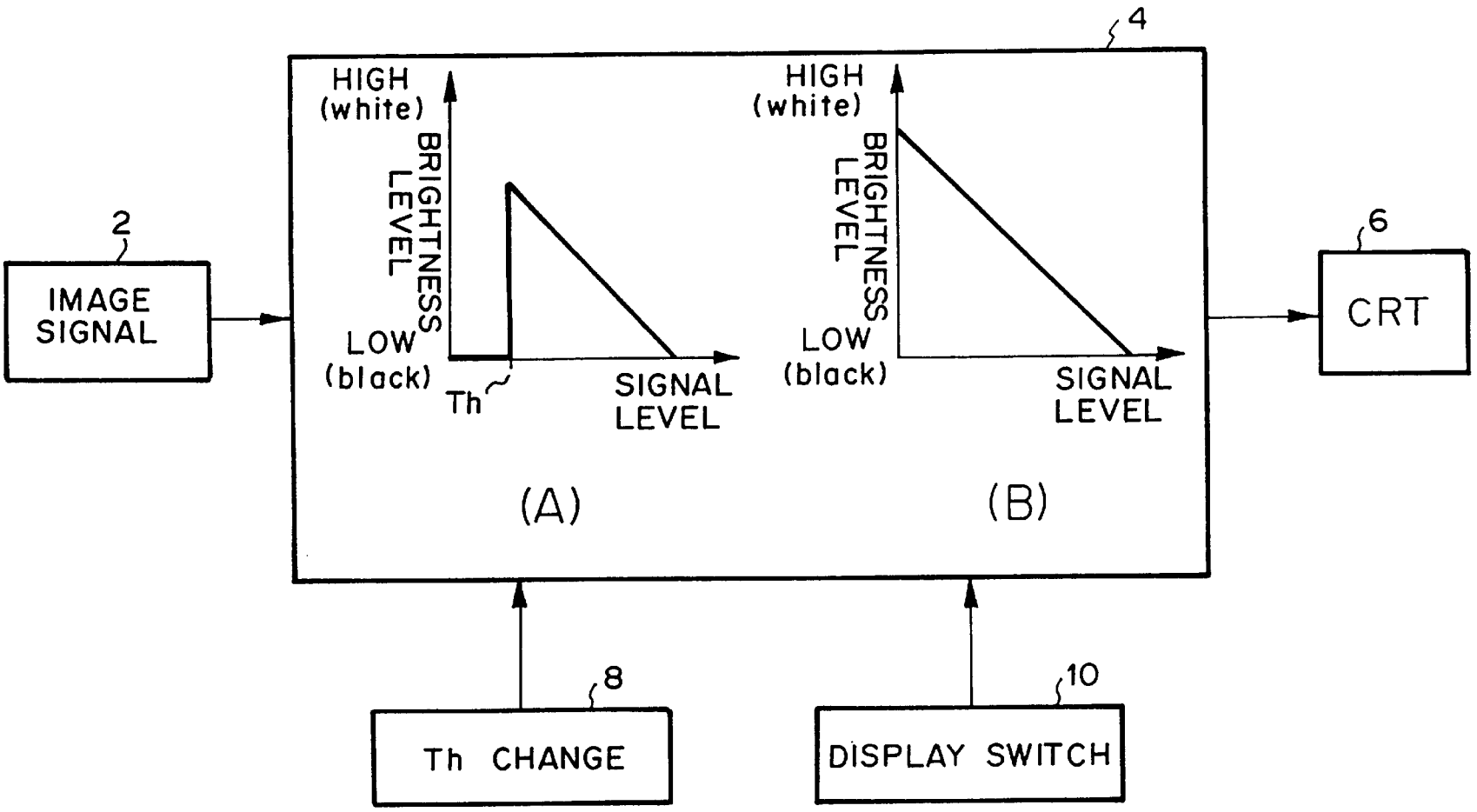
FIGS. 1, 7 and 8 are block diagrams for illustrating an example of a system for carrying out the method in accordance with the first aspect of the present invention.
Figure 7:
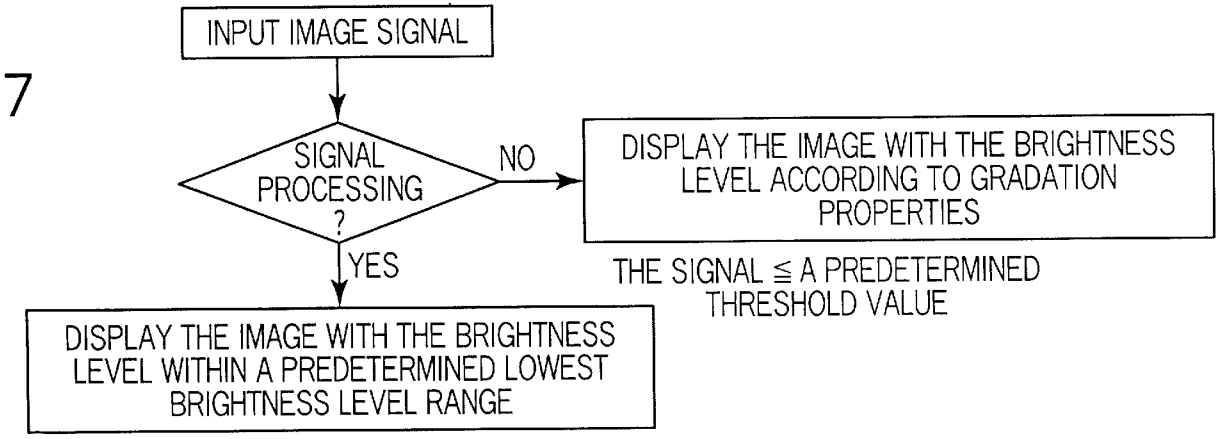
Figure 8:
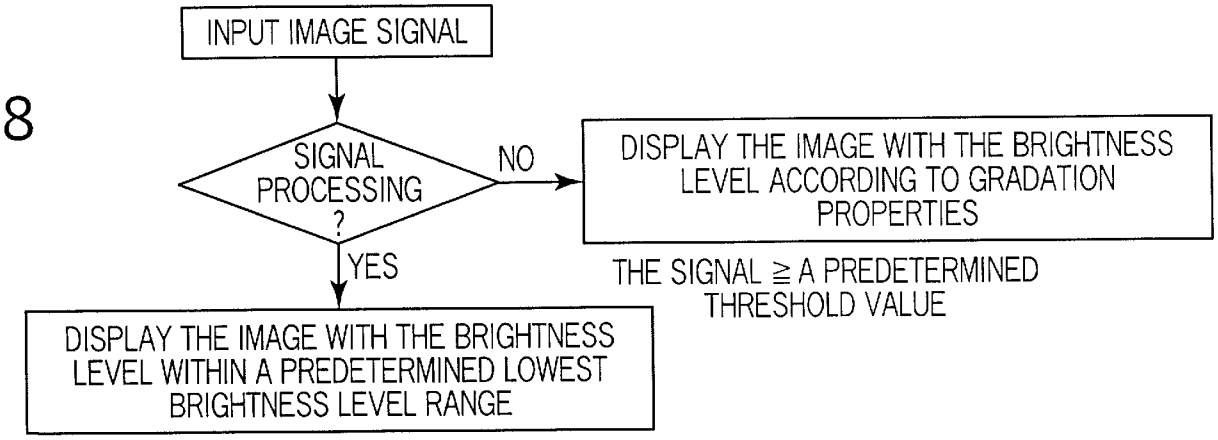

Referring to FIGS. 1, 7 and 8, a system for carrying out the method in accordance with the first aspect of the present invention comprises a signal processing means 4 which processes an image signal 2 input thereinto, and a CRT 6 on which an image represented by the image signal 2 is reproduced as a visible image on the basis of the processed image signal processed by the signal processing means 4.

The signal processing means 4 changes the signal levels of the respective signal components of the image signal 2 so that the picture elements corresponding to the signal components are displayed on the CRT 6 according to the gradation property line (A) shown in FIG. 1. The gradation properties shown by the gradation property line (A) basically lower the brightness level of a picture element as the signal level for the picture element becomes higher while fixing the brightness level of a picture element to a lowest level when the signal level for the picture element is not higher than a predetermined threshold value Th.

The threshold value Th is set at a value higher than the highest value of the image signal levels for the area outside the irradiation field or a value close to the highest value and preferably at a value lower than the lowest value of the image signal levels for the area inside the irradiation field and higher than the highest value of the image signal levels for the area outside the irradiation field or a value close to the highest value. The highest value of the image signal levels for the area outside the irradiation field and the lowest value of the image signal levels for the area inside the irradiation field can be empirically known and the threshold value Th may be conveniently determined on the basis of the highest value of the image signal levels for the area outside the irradiation field and the lowest value of the image signal levels for the area inside the irradiation field.

The threshold value Th may be a fixed value but may be changed according to the image to be reproduced. That is, the signal processing means 4 may be provided with a threshold value changing means 8. The threshold value changing means 8 may be arranged so that the threshold value Th can be set at any value or that the threshold value Th can be set at one of a plurality of preset values. Further change of the threshold value Th may be carried out interactively. That is, the image signal is processed by use of a certain threshold value and the image is reproduced on the CRT on the basis of the image signal thus processed. Then the threshold value is changed viewing the reproduced image.

Though, in the system shown in FIG. 1, the brightness level of a picture element is fixed to a lowest level when the signal level for the picture element is not higher than a predetermined threshold value Th, it need not be fixed exactly to the lowest level but may be fixed to a level within a predetermined lowest brightness level range having a predetermined width from the lowest level. The lowest brightness level range is such a range that when a picture element is displayed on the CRT at a brightness level within the range, the picture element is visually recognized to be black (black level).

The signal processing means 4 is further provided with a display switching means 10 which switches the gradation properties, according to which the signal processing means 4 changes the signal levels of the respective signal components of the image signal 2, from those shown by the gradation property line (A) to those shown by the gradation property line (B) and from the latter to the former. The gradation properties shown by the gradation property line (B) are the normal properties which lower the brightness level of a picture element as the signal level for the picture element becomes higher.

Figure 9:
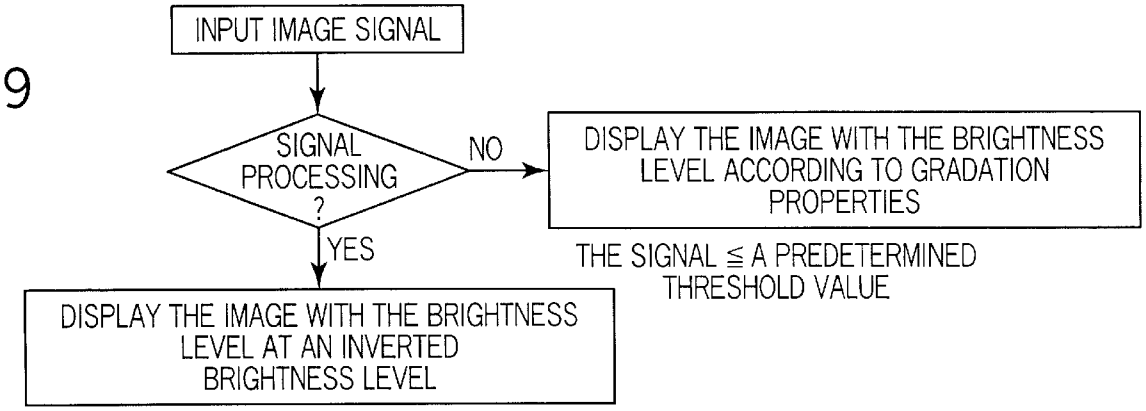
Figure 10:
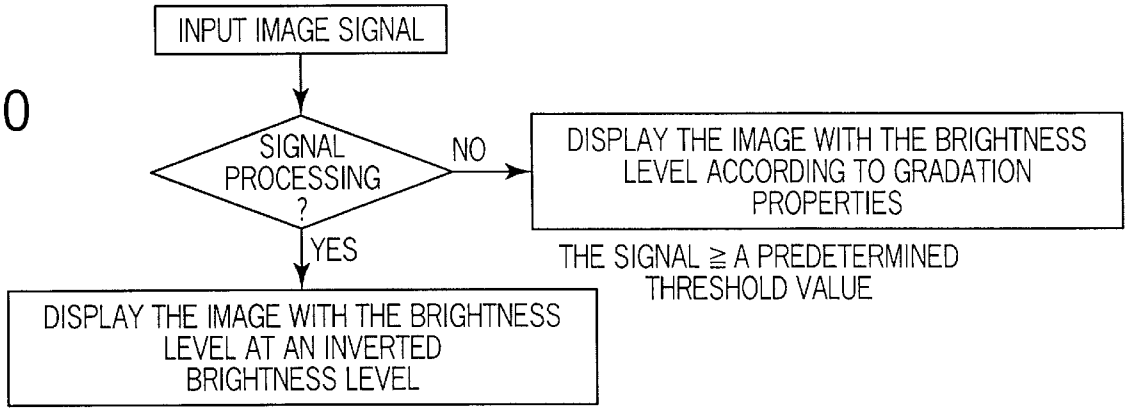

A system for carrying out the method in accordance with the third aspect of the present invention will be described with reference to FIGS. 2, 9 and 10, hereinbelow.

Figure 2:
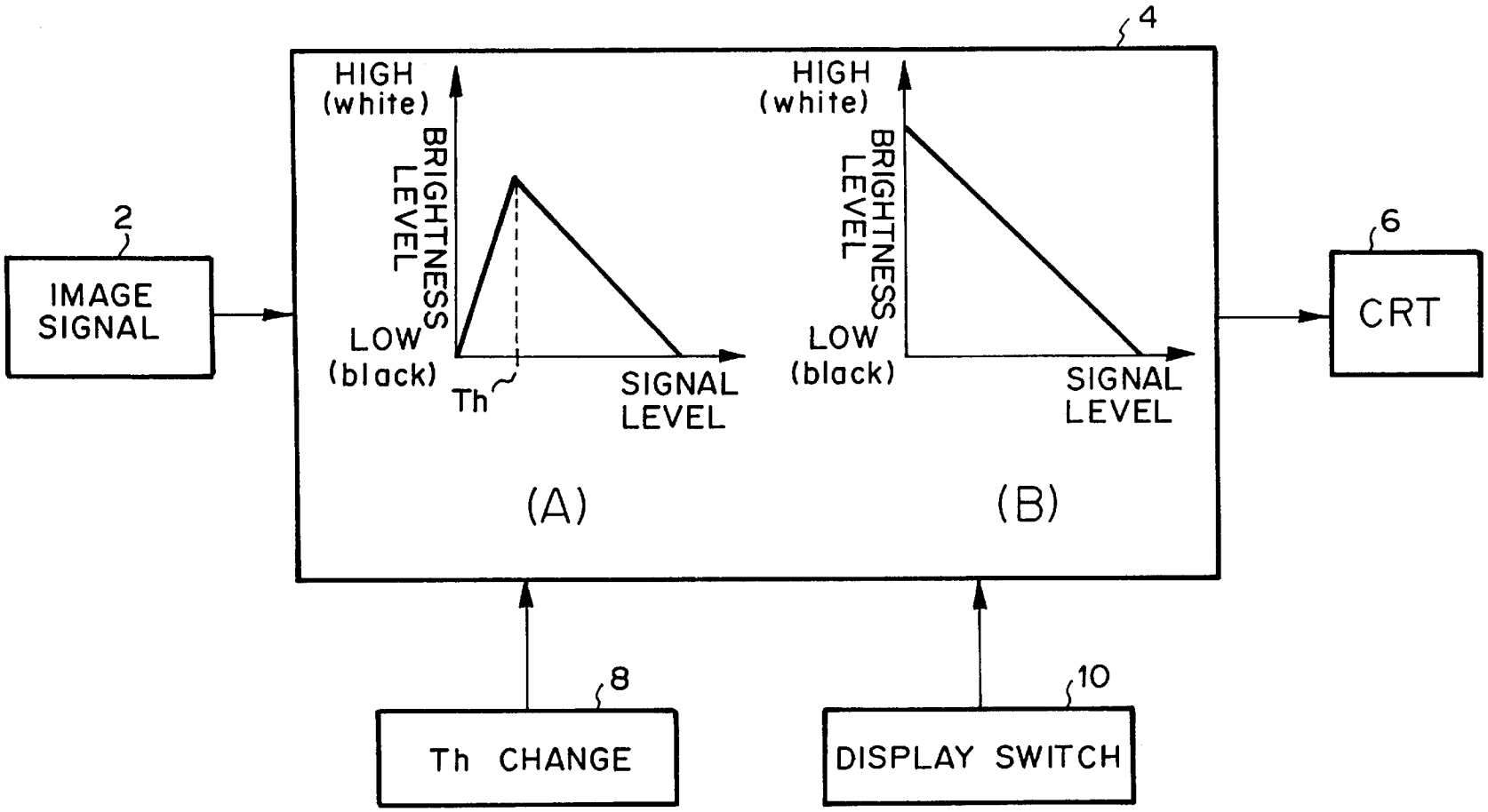
FIGS. 2, 9 and 10 are block diagrams for illustrating an example of a system for carrying out the method in accordance with the third aspect of the present invention.

In the system shown in FIG. 2, the gradation properties shown by gradation property line (A) in FIG. 2 are employed in place of those shown by the gradation property line (A) in FIG. 2. The gradation properties shown by the gradation property line (A) in FIG. 2 basically lower the brightness level of a picture element as the signal level for the picture element becomes higher while inverting the brightness level of a picture element when the signal level for the picture element is not higher than a predetermined threshold value Th. That is, the signal processing means 4 changes the signal levels of the respective signal components of the image signal 2 so that the picture elements corresponding to the signal components are displayed on the CRT 6 according to the basic gradation properties when the signal level is higher than the threshold value Th and according to the inverted gradation properties when the signal level is not higher than the threshold value Th. According to the inverted gradation properties, the brightness level of a picture element is lowered as the signal level for the picture element becomes lower.

The system shown in FIG. 2 is the same as that shown in FIG. 1 except that the gradation property line (A) differs from that employed in the system shown in FIG. 1. Accordingly, the elements analogous to those in FIG. 1 are given the same reference numerals and will not be described here.

Figure 11:
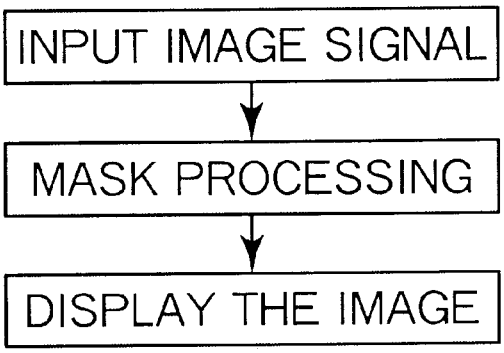

A system for carrying out the method in accordance with the fifth aspect of the present invention will be described with reference to FIGS. 3 and 11, hereinbelow.

Figure 3:
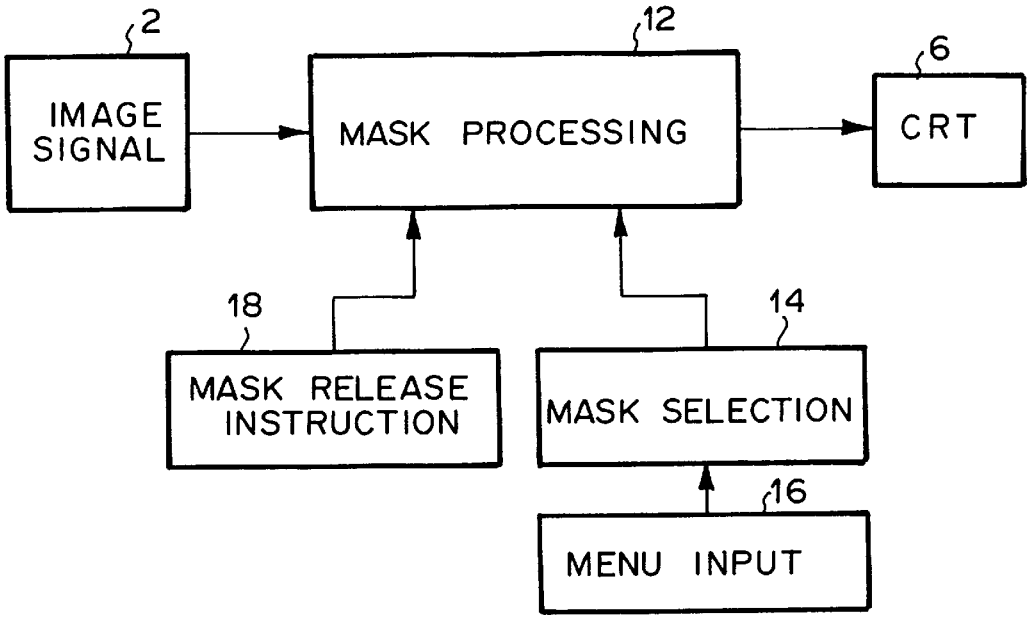
FIGS. 3 and 11 are block diagrams for illustrating an example of a system for carrying out the method in accordance with the fifth aspect of the present invention.

The system shown in FIG. 3 comprises a mask processing means 12 which processes an image signal 2 input thereinto with a mask and a CRT 6 on which an image is reproduced as a visible image by use of the processed image signal.

The mask processing means 12 processes the image signal using a mask so that each picture element in the area covered by the mask is displayed at a brightness within a predetermined lowest brightness level range.

This system is effective when the area outside the irradiation field is known. For example, in the case of a group examination, a plurality of radiation images are recorded with the same irradiation field stop. Accordingly the radiation images have the same areas outside the irradiation field which are known. In such a case, the image signals are processed with a mask corresponding to the area outside the irradiation field.

Figure 6A:
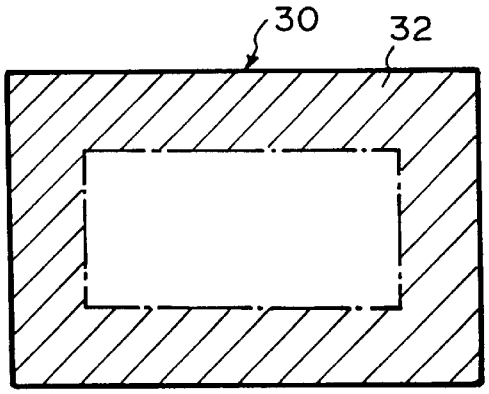
FIGS. 6A and 6B are views showing examples of visible images reproduced in accordance with the methods of the present invention.
Figure 6B:
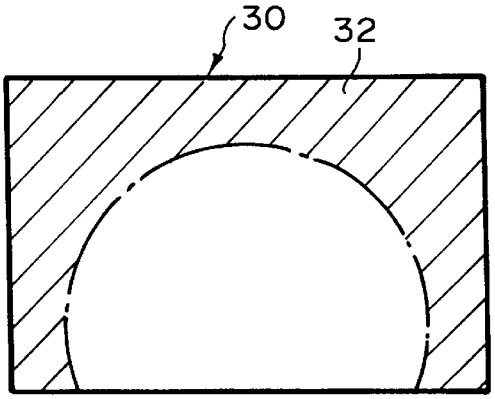

Though one preset mask may be used, it is possible to arrange the system so that an optimal mask can be selected from a plurality of masks respectively corresponding to various areas outside the irradiation field since there are various patterns of irradiation field. Since the pattern of the irradiation field stop is generally determined according to the menu of the radiation image recording (For example, a semicircular irradiation field stop such as shown in FIG. 6B is often used for recording a radiation image of breast, and a rectangular irradiation field stop such as shown in FIG. 6A is often used for recording a radiation image of neck as will be described later), the system shown in FIG. 3 is provided with a mask selecting means 14 which has a plurality of masks respectively corresponding to menus and selects one of the masks according to menu information input from a menu input means 16. That is, the menu of the radiation image is input into the mask selecting means 14 through the menu input means 16 and the mask selecting means 14 selects a mask according to the menu of the radiation image and inputs information on the mask selected into the mask processing means 12. The mask processing means 12 processes the image signal 12 on the basis of the information on the mask.

The system is further provided with a mask release instruction input means 18 which inputs an instruction to direct the mask processing means 12 to interrupt the mask processing.

Another system for carrying out the method in accordance with the fifth aspect of the present invention will be described with reference to FIG. 4, hereinbelow.

Figure 4:
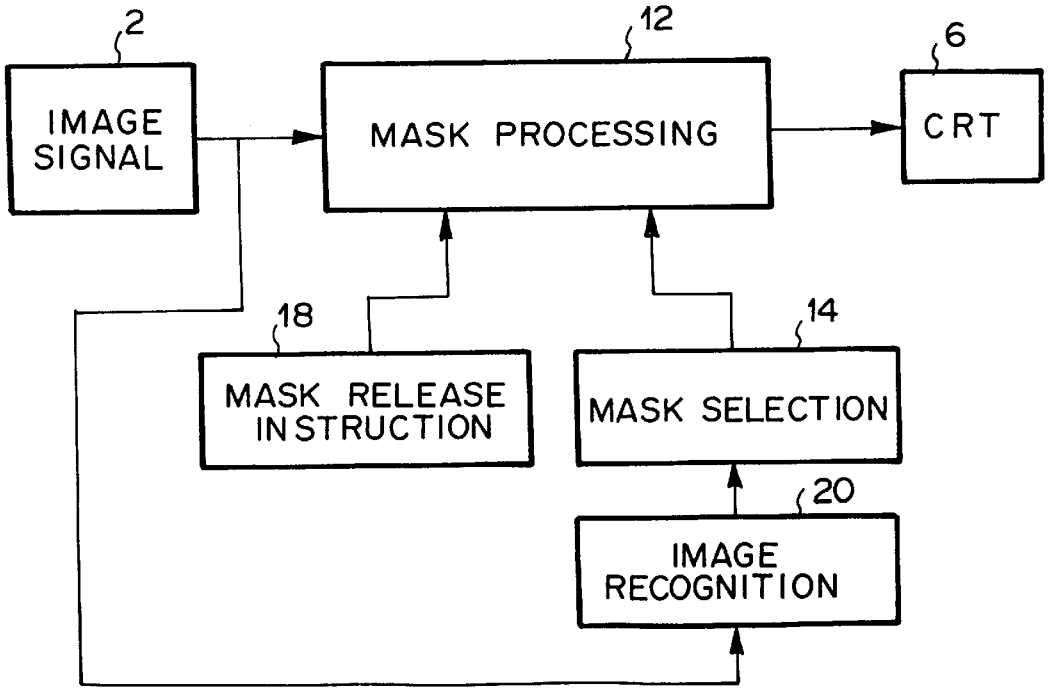
FIG. 4 is a block diagram for illustrating another example of a system for carrying out the method in accordance with the fifth aspect of the present invention.

The system shown in FIG. 4 is substantially the same as the system shown in FIG. 3 except that an automatic image recognizing means 20 is employed in place of the menu input means 16. Accordingly the elements analogous to those in FIG. 3 are given the same reference numerals and will not be described here. In the system shown in FIG. 4, the automatic image recognizing means 20 recognizes the kind of the image represented by the image signal and inputs it into the mask selecting means 14. The mask selecting means 14 selects a mask according to the kind of the image and inputs information on the mask selected into the mask processing means 12. The mask processing means 12 processes the image signal 12 on the basis of the information on the mask.

Figure 5:
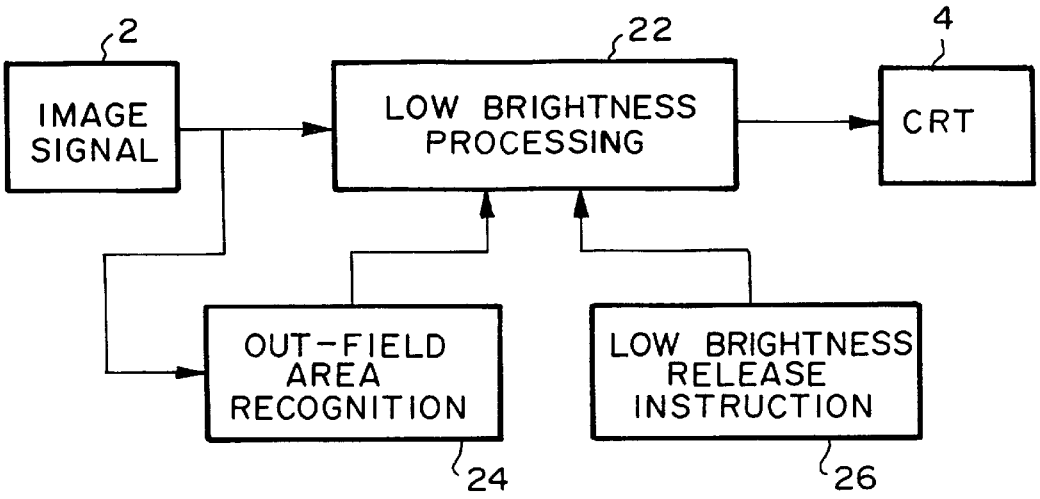
FIGS. 5 and 12 are block diagrams for illustrating an example of a system for carrying out the method in accordance with the seventh aspect of the present invention.
Figure 12:
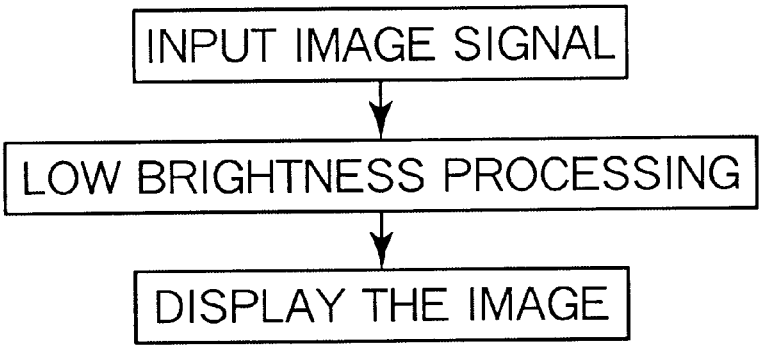

A system for carrying out the method in accordance with the seventh aspect of the present invention will be described with reference to FIGS. 5 and 12, hereinbelow.

The system comprises a low brightness processing means 22 which processes an image signal 2 input thereinto, and a CRT 6 on which an image represented by the image signal 2 is reproduced as a visible image on the basis of the processed image signal processed by the low brightness processing means 22.

The low brightness processing means 22 receives information on the area outside the irradiation field from an out-field area recognizing means 24 and changes the level of the image signal component for each picture element in the recognized area outside the irradiation field so that the picture element is displayed at a brightness within a predetermined lowest brightness level range.

The out-field area recognizing means 24 recognizes the irradiation field from the image signal 2 by a known method and then recognizes the area outside the irradiation field.

As the method of recognizing the irradiation field, there have been known a method in which the image signal components are differentiated and the irradiation field is recognized on the basis of the differentiated values (see, for instance, U.S. Pat. Nos. 4,851,678 and 4,931,644), a method in which, in a differentiated image obtained by differentiation processing of the image signal, picture elements whose differentiated values are the maximum in adjacent picture elements or larger than a predetermined value are joined and the area within a closed loop obtained is recognized to be the irradiation field (see, U.S. Pat. Nos. 4,851,678 and 4,931,644), a method in which correlations between a differentiated image obtained by differentiation processing of the image signal and a large number of templates are determined and the irradiation field is recognized on the basis of the template having the largest correlation with the differentiated image (see, U.S. Pat. Nos. 4,851,678 and 4,931,644, and other various methods such as disclosed in U.S. Pat. Nos. 4,864,133, 4,806,756, and 4,806,759 and Japanese Unexamined Patent Publication No. 63(1988)-100437.) The irradiation field may be recognized various methods including those known methods.

The system is further provided with a low brightness release instruction input means 26 which inputs an instruction to direct the low brightness processing means 22 to interrupt the low brightness processing, thereby switching the mode of reproduction from a low brightness mode in which the area outside the irradiation field is displayed at a low brightness to a normal mode in which the brightness level of a picture element is lowered as the signal level for the picture element becomes higher also in the area outside the irradiation field.

FIG. 6A shows an example of a visible image reproduced on the CRT by use of an image signal obtained from an image which has been taken using a rectangular irradiation field stop and FIG. 6B shows an example of a visible image reproduced on the CRT by use of an image signal obtained from an image which has been taken using a semicircular irradiation field stop. In each of FIGS. 6A and 6B, the hatched portion 32 of the reproduced image 30 is the area outside the irradiation field and is displayed at a low brightness or at a black level.

In each of the examples described above, the image signal is obtained from a radiation image recorded on a stimulable phosphor sheet and the image signal level of the area outside the irradiation field is lower than that of the area inside the irradiation field. The radiation image is reproduced by use of such an image signal on a light emission display means such as a CRT according to gradation properties where the brightness level of a picture element becomes higher as the level of the image signal component for the picture element becomes lower. However there also has been known an image reproduction where an X-ray image of an object is recorded on an X-ray film, the X-ray film is developed, an image signal is obtained by scanning the developed X-ray film and reading out transmitted light or reflected light (digitization of an X-ray film), and the X-ray image is reproduced as a visible image on a light emission display means such as a CRT on the basis of the image signal.

In this case, the image signal level of the area outside the irradiation field is higher than that of the area inside the irradiation field and the X-ray image is displayed on the light emission display means according to gradation properties where the brightness level of a picture element becomes higher as the level of the image signal component for the picture element becomes higher. The methods in accordance with the second, fourth, sixth and eighth aspects of the present invention described above are applied to such an image display. That is, the method in accordance with the second aspect differs from that in accordance with the first aspect in that a picture element the signal level of the image signal component for which is not lower than a predetermined threshold value is displayed at a brightness within a predetermined lowest brightness level range unlike in the method of the first aspect where a picture element the signal level of the image signal component for which is not higher than a predetermined threshold value is displayed at a brightness within a predetermined lowest brightness level range. Similarly the method in accordance with the fourth aspect differs from that in accordance with the third aspect in that a picture element the signal level of the image signal component for which is not higher than a predetermined threshold value is displayed at an inverted brightness level unlike in the method of the third aspect where a picture element the signal level of the image signal component for which is not lower than a predetermined threshold value is displayed at an inverted brightness level. The methods of the sixth and eighth aspects can be carried out in the same manner respectively as the methods of the fifth and seventh aspects.

In the methods of second and fourth aspects, the threshold value Th is set at a value higher than the highest value of the image signal levels for the area inside the irradiation field or a value close to the highest value and preferably at a value lower than the lowest value of the image signal levels for the area outside the irradiation field and higher than the highest value of the image signal levels for the area inside the irradiation field or a value close to the highest value.

In accordance with the methods of the present invention, the area outside the irradiation field is reproduced at a low brightness and accordingly deterioration in contrast of the area inside the irradiation field due to scattered light from the area outside the irradiation field can be prevented, whereby deterioration in diagnostic performances can be prevented.

Though, in the examples described above, a CRT is employed as the light emission display means, any display means can be employed so long as it displays an image by light emission. For example, a flat panel display such as a plasma display, a liquid crystal display and the like may be employed. Also in such a light emission display means, scattered light is basically generated by light emission and deterioration in contrast due to the scattered light can be prevented in accordance with the present invention.

Further, in the examples described above, the present invention is applied to a medical image display. This is because the problem of deterioration in contrast is important especially in the medical image display and the methods of the present invention can also be applied to other image displays.

What is claimed is:

1. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is lower than the image signal components obtained from an area inside the irradiation field; and processing the image signal for displaying the image on the light emission display system according to gradation properties to increase a brightness level of a picture element when the level of the image signal component for the picture element decreases and to maintain the brightness level of a picture element within a predetermined lowest brightness level range when the signal level of the image signal component for the picture element is not higher than a predetermined threshold value.

2. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is higher than the image signal components obtained from an area inside the irradiation field; and processing the image signal for displaying the image on the light emission display system according to gradation properties to increase a brightness level of a picture element when the level of the image signal component for the picture element increases and to maintain the brightness level of a picture element within a predetermined lowest brightness level range when the signal level of the image signal component for the picture element is not lower than a predetermined threshold value.

3. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is lower than the image signal components obtained from an area inside the irradiation field; and processing the image signal for displaying the image on the light emission display system according to gradation properties to increase a brightness level of a picture element when the level of the image signal component for the picture element decreases and to maintain the brightness level of a picture element at an inverted brightness level, which is an inverted value of the brightness level, when the signal level of the image signal component for the picture element is not higher than a predetermined threshold value.

4. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is higher than the image signal components obtained from an area inside the irradiation field; and processing the image signal for displaying the image on the light emission display system according to gradation properties to increase a brightness level of a picture element when the level of the image signal component for the picture element increases and to maintain the brightness level of a picture element at an inverted brightness level, which is an inverted value of the brightness level, when the signal level of the image signal component for the picture element is not lower than a predetermined threshold value.

5. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is lower than the image signal components obtained from an area inside the irradiation field; and processing the image signal for displaying the image on the light emission display system according to gradation properties to increase a brightness level of a picture element when the level of the image signal component for the picture element decreases, and processing the image signal for displaying the image on the light emission display system using a mask corresponding to the area outside the irradiation field to maintain the brightness level of each picture element in the area outside the irradiation field within a predetermined lowest brightness level range when the area outside the irradiation field is known.

6. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is higher than the image signal components obtained from an area inside the irradiation field; and processing the image signal, for displaying the image on the light emission display system, according to gradation properties to increase a brightness level of a picture element when the level of the image signal component for the picture element increases, and processing the image signal, for displaying the image on the light emission display system, using a mask corresponding to the area outside the irradiation field to maintain the brightness level of each picture element in the area outside the irradiation field within a predetermined lowest brightness level range when the area outside the irradiation field is known.

7. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is lower than the image signal components obtained from an area inside the irradiation field; and processing the image signal for displaying the image on the light emission display system according to gradation properties to increase a brightness level of a picture element when the level of the image signal component for the picture element decreases, and processing the image signal for displaying the image on the light emission display system by identifying the area outside the irradiation field on the basis of the image signal, and maintaining each picture element in the recognized area outside the irradiation field at a brightness within a predetermined lowest brightness level range.

8. A method of reproducing an image on a light emission display system using an image signal obtained from the image, the method comprising:

generating an image signal from an image which is obtained by use of an irradiation field stop, wherein image signal components obtained from an area outside the irradiation field have a signal level which is higher than the image signal components obtained from an area inside the irradiation field; and processing the image signal for displaying the image on the light emission display system according to gradation properties to increase a brightness level of a picture element when the level of the image signal component for the picture element increases, and processing the image signal for displaying the image on the light emission display system by identifying the area outside the irradiation field on the basis of the image signal, and maintaining each picture element in the recognized area outside the irradiation field at a brightness within a predetermined lowest brightness level range.

* * * * *